United States Patent [19]

Ueno

[11] Patent Number: 4,958,553

[45] Date of Patent: Sep. 25, 1990

[54] HYDRAULIC CONTROLLER

[75] Inventor: Katsumi Ueno, Saitama, Japan

[73] Assignee: Diesel KIKI Co., Ltd., Tokyo, Japan

[21] Appl. No.: 341,357

[22] Filed: Apr. 20, 1989

[30] Foreign Application Priority Data

Apr. 22, 1988 [JP] Japan ..... 63-53538
Apr. 22, 1988 [JP] Japan ..... 63-53539

[51] Int. Cl.[5] ..... F15B 13/042

[52] U.S. Cl. ..... 91/447; 91/461; 137/596.15

[58] Field of Search ..... 91/447, 461; 137/596.15

[56] References Cited

U.S. PATENT DOCUMENTS 4,290,447 9/1981 Knutson ..... 91/447 X
4,569,273 2/1986 Anderson et al. ..... 91/447

FOREIGN PATENT DOCUMENTS 52-26598 7/1977 Japan .

*Primary Examiner*—Gerald A. Michalsky
*Attorney, Agent, or Firm*—Henry c. Nields

[57] ABSTRACT

A spool type directional control valve switches flow of oil discharged from an oil hydraulic pump to a hydraulic actuator, and decreases internal leak of a cylinder. Two sets of separated cylinder passages are formed on a valve body provided with a main spool, and a nonleak valve is provided across them. The nonleak valve is equipped with a main passage switching puppet having a throttle on the nose, a spring for energizing it to a close side, a pilot poppet for controlling pressure of a spring chamber in which the spring is enclosed, and a piston for operating the poppet.

11 Claims, 8 Drawing Sheets

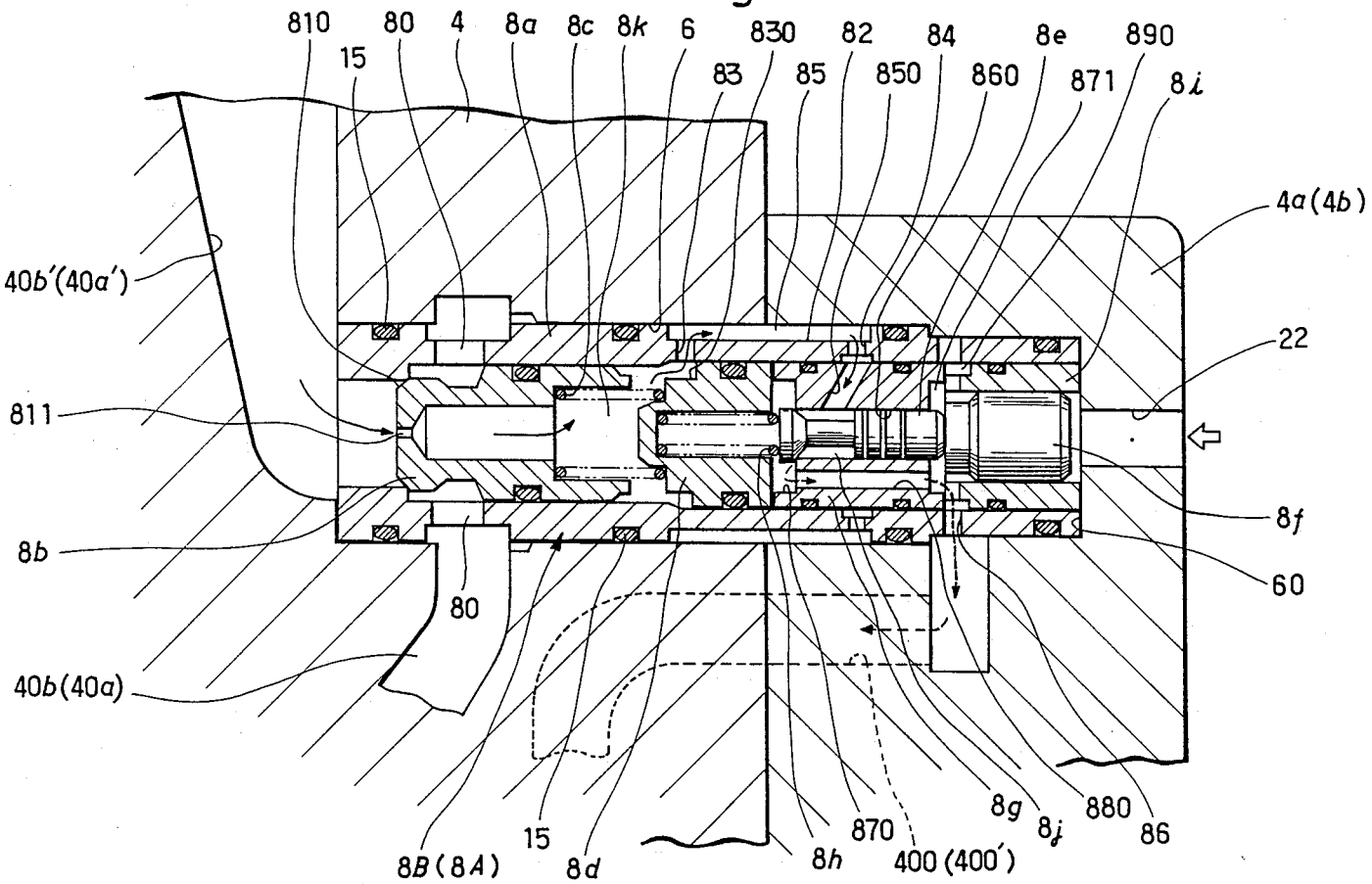
Fig. 1-A

Fig. 2-A
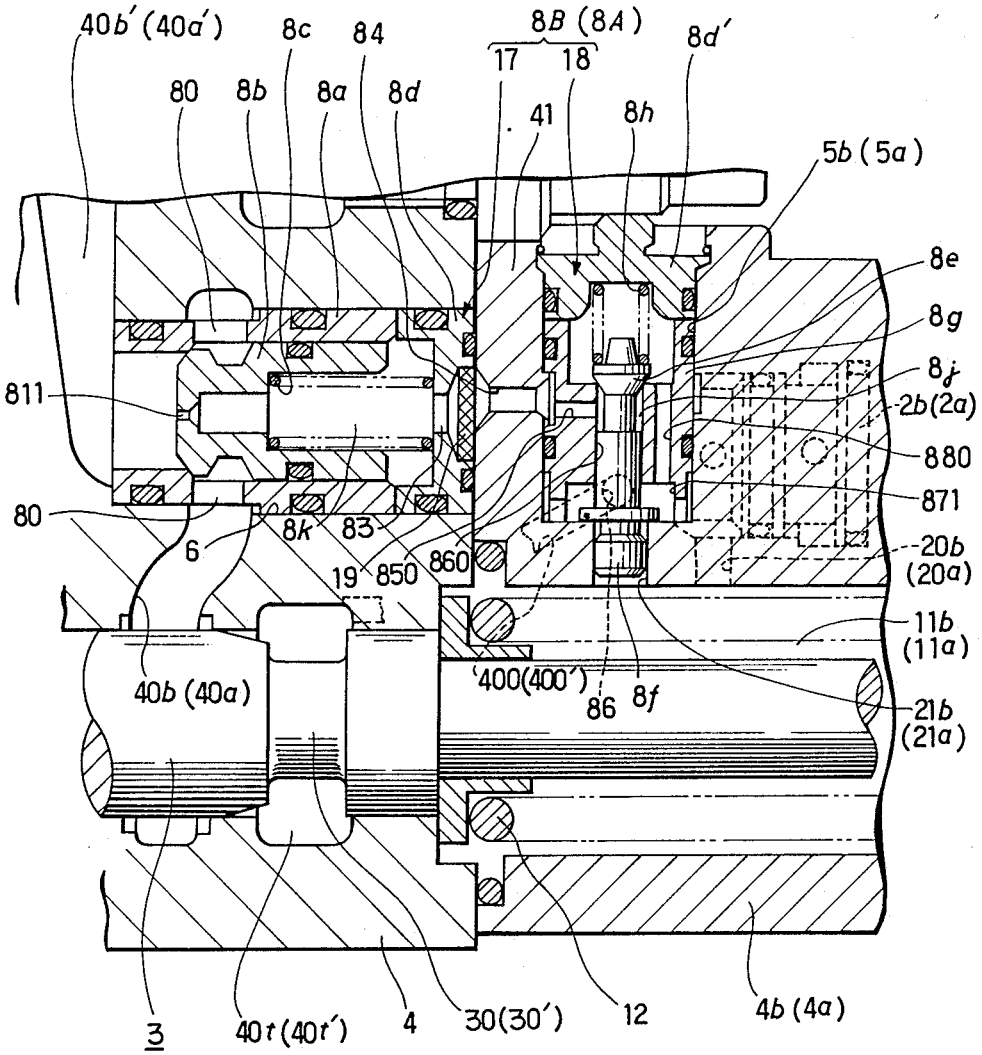

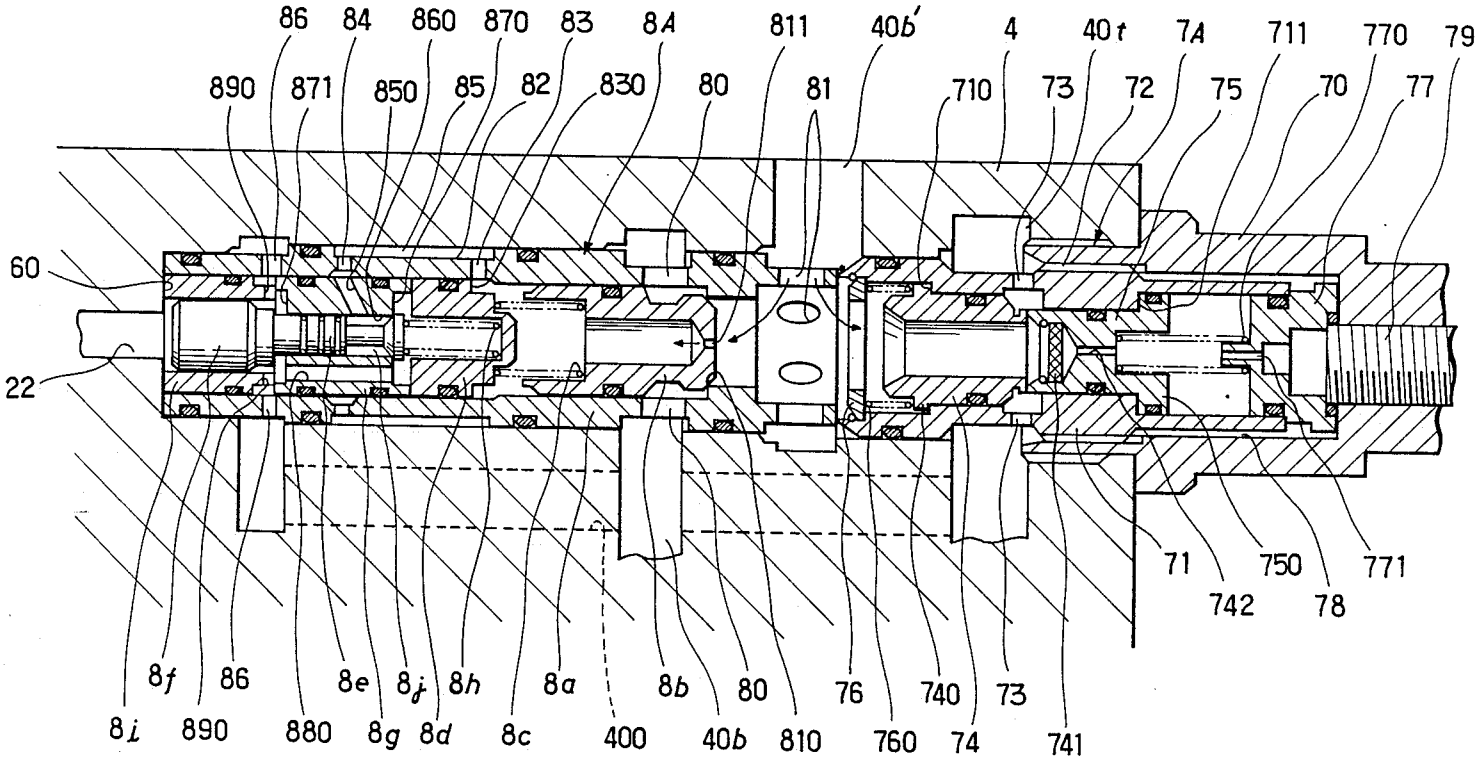
Fig. 3-A

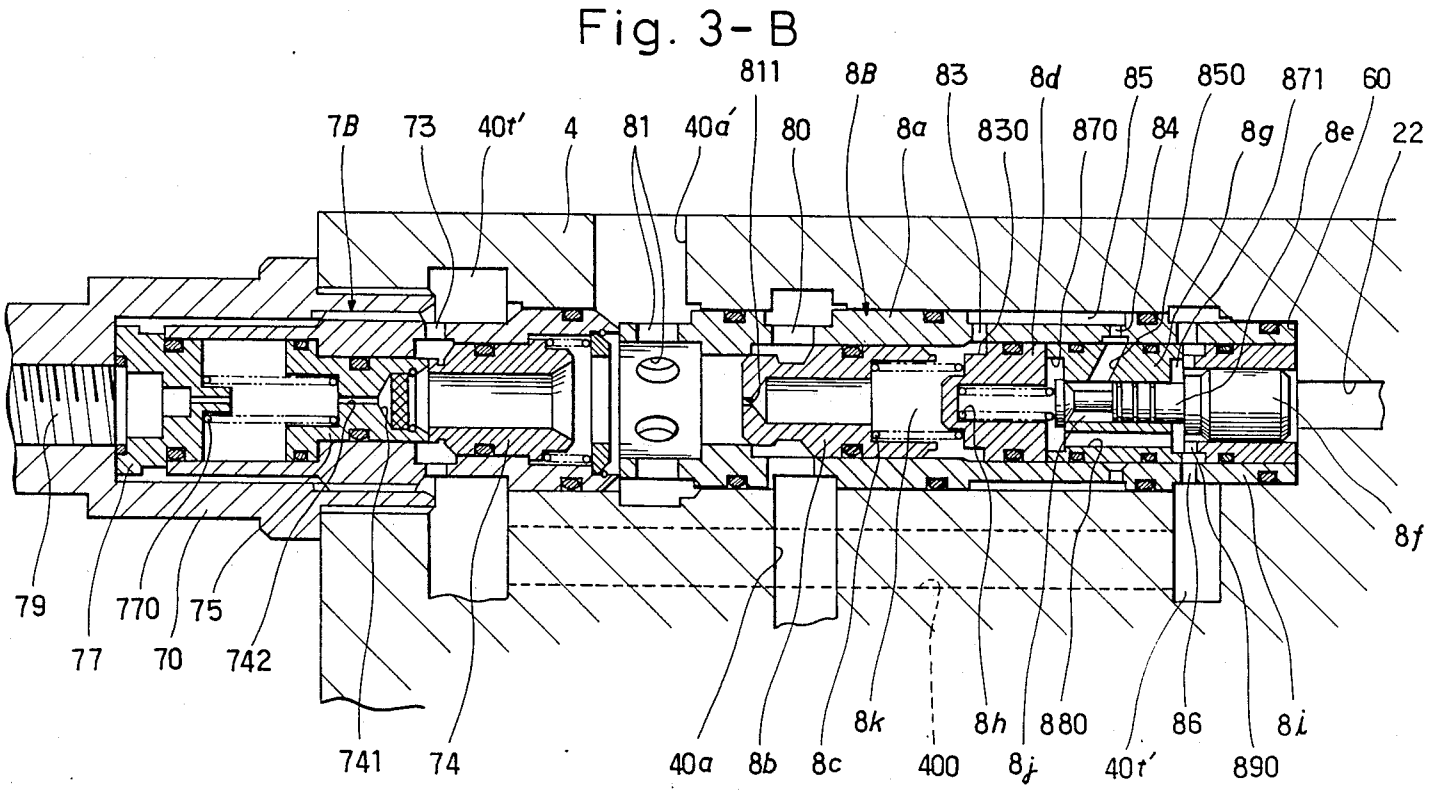
Fig. 3-B

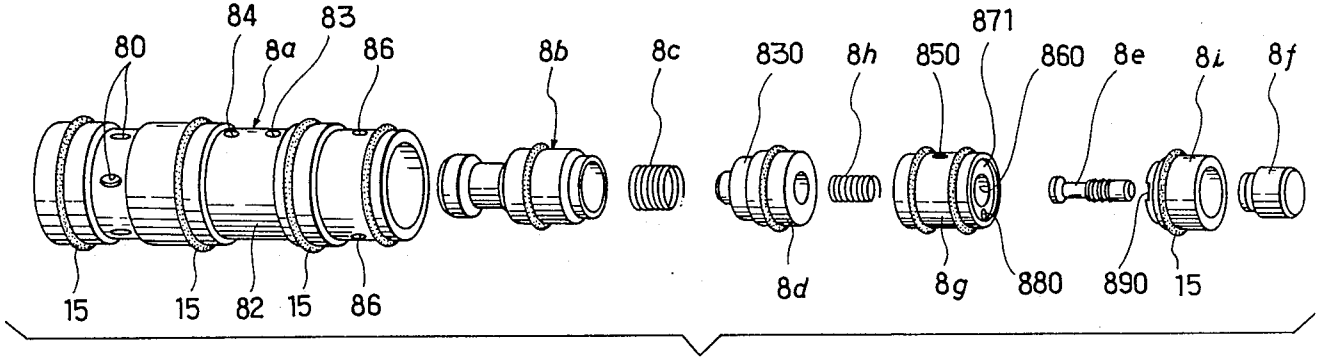
Fig. 4
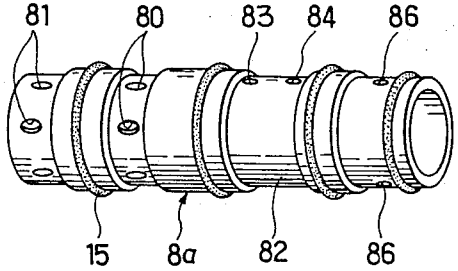
Fig. 4-A

HYDRAULIC CONTROLLER

BACKGROUND OF THE INVENTION

1. Field of the Invention

The present invention relates to a hydraulic controller and, more particularly, to a hydraulic controller provided with a function to decrease an internal leakage of a cylinder port of a spool valve.

2. Description of the Prior Art

A hydraulic system for industrial equipment including civil engineering and construction equipment and agricultural equipment is equipped with an oil hydraulic pump and a hydraulic actuator for oil hydraulic motor, hydraulic cylinder and the like, and a control valve is further provided between the oil hydraulic pump and the hydraulic actuator.

A spool type directional control valve (hereinafter simply called "spool valve") is used generally for the aforementioned control valve, operating for line switching and throttle switching so as to run the hydraulic actuator forward and backward or stop it halfway.

Since the spool valve is framed to slide a bore of the valve body, an appropriate clearance is present between the bore and the spool. Accordingly, it is unavoidable that an internal leak may arise in an internal passage of the valve body and particularly in a cylinder port. Particularly in a double-acting actuator, such internal leak is capable of deteriorating a load carrying capacity. That is, the cylinder port is connected to the actuator circuit, and a load pressure of the actuator is enclosed in the cylinder port. Accordingly, the load pressure leaks to a tank port on low pressure side along a clearance between a neutral spool outer peripheral portion and a bore, and thus a load cannot be retained and the actuator moves bit by bit according to the lapse of time.

For countermeasure it is conceivable that a poppet be used instead of the spool valve, however, a valve construction becomes large-scaled, which inevitably leads to a high cost. Now, therefore, a spool valve provided with a pilot check valve on a passage in a valve body reaching a cylinder port is disclosed in Japanese Patent Publication No. 26598/1977.

According to the prior art, a presence of the pilot check valve is effective in minimizing an internal leak, and thus a load retention of the cylinder which is an actuator is realizable. However, the prior art comprises an internal pilot system for pushing the pilot piston on a pump pressure. Thus, the piston must be enlarged in size for fine flow control. Practically, however, the pilot piston cannot be made so big in size for space requirement in the valve body.

Consequently, after the notch of a main spool passes mostly, pressure rises to actuate the pilot piston, a check valve then opens, and thus it is unavoidable that a fairly big shock may arise. Accordingly, a problem is such that a pertinent nonleak mechanism with high flow controllability cannot be realized.

Further, in the prior art, the pilot piston and the check valve are disposed opposite each other across a cylinder passage (the pilot check valve being incorporated in the valve body). Then, when the main spool moves, a hydraulic fluid is fed near a hydraulic fluid return side passage on a counter side across a cylinder port passage on a feed side, thus pushing and moving the pilot piston. A passage construction of the valve body becomes complicate consequently.

SUMMARY OF THE INVENTION

An object of the invention is to provide a hydraulic controller, compact in structure, simple in a passage construction of a valve body, and provided with a function to prevent an internal leak of a cylinder port. In particular, a main spool is actuated, and before a notch provided thereon opens a main passage in a valve body, the valve opens to return the fluid from an actuator smoothly to a tank, thus providing a hydraulic controller satisfactory in fine controllability of flow rate.

In order to attain the aforementioned object, the invention comprises employing a special hydraulic pilot-actuated nonleak valve, mounting it on a valve body so that a main flow switching valve portion at least will cross separate passages leading to a cylinder port of a spool valve, guiding a pilot oil pressure for actuating a main spool to the nonleak valve at the same time, opening and actuating the nonleak valve before switching or throttle of the main spool functions.

That is, a basic feature of the invention is as follows.

First, the main spool is a directional control valve operated on an external pilot oil pressure, and the two nonleak valves are provided each with a poppet for switching a main passage with a throttle on the nose, a spring for energizing it to a close side all the time, a pilot poppet for controlling pressure of a spring chamber with the spring disposed therein, and a piston for operating the pilot poppet.

Two cylinder passages of a valve body are not led to a cylinder port through a single passage from an outer periphery of the main spool but are of a separate structure. That is, a nose of the one passage communicating with the spool outer periphery ends halfway in the valve body to be blind, a nose of the other passage leads to the cylinder port with the terminal stopped at a position shifted in phase with the one passage. Then, a horizontal tunnel is formed in the valve body for the nose of the one passage of such separate structure to intersect the terminal of the other passage. The nonleak valve has the entirety or at least the main passage switching poppet put in the horizontal tunnel, thus separating the one passage from the other passage in a sealed (valve closed) state.

Then, the nonleak valve has a passage structure internally, and thus when the main spool is neutral, that is, the actuator is shut down, a load oil pressure working on the cylinder port is shut up. The passage structure comprises main passage switching poppet throttle→spring chamber→horizontal tunnel →pilot poppet valve chest.

A passage branched from a main spool operating pilot oil pressure passage (including that of chamber structure) leads to the back of a piston of the nonleak valve, and thus when a pilot oil pressure is applied to the main spool, the pilot oil pressure works on the piston concurrently, and the pilot poppet and the main passage switching poppet open.

Thus, the following effect will be obtainable through the invention. That is, the nonleak valve is disposed in a nose direction of the horizontal tunnel separating passages to the cylinder port, and the passages to the cylinder port are intercepted by the main passage switching poppet in the normal condition. Accordingly, a load pressure from the cylinder port passes a throttle on a nose of the main passage switching poppet, and is shut up in the pilot poppet valve chest. Since a leak from the valve chest is minimized, the hydraulic actuator (cylinder, for example) is securely positioned.

When the main spool is actuated, the pilot pressure is led to the piston concurrently, and the pilot poppet opens first on a push of the piston. An oil in the pilot poppet chest then flows into a tank port, and a pressure of the main passage switching poppet is lowered thereby. As a result, a pressure difference arises longitudinally of the throttle, therefore the main passage switching poppet opens, the separate passages come to communicate with each other, and an oil from the actuator passes through to the tank port.

In the invention, a rear piston is operated on a pilot oil pressure for operating the main spool, and thus the main passage switching poppet is actuated, therefore a full size or particularly a diameter can be minimized to a compact structure, and a passage construction of the valve body can also be simplified.

Regardless of a magnitude of load pressure of the actuator, an opening pressure of the main passage switching poppet may be set according to a size of the throttle and force of the spring. Accordingly, the pilot oil pressure of the main spool will be utilized as aforementioned, and at the same time the nonleak valve can be opened swiftly before a notch of the main spool communicates with a passage of the bore. Thus, a flow rate can be controlled fine accurately by the notch. Then, an improper shock will not result at the time of operation.

Then, the nonleak valve linear as a whole may be mounted on a portion covering the valve body and cover plates on opposite sides thereof. Then, it may be segmented otherwise into two assemblies, of which the first assembly including the main passage switching poppet will be disposed on the valve body, while the second assembly incorporating residual elements therein will be disposed longitudinally on a subplate side. Further, the nonleak valve may be incorporated in the valve body coaxially with an overload relief valve.

Other objects and preferred constructions of the invention will become obvious from a detailed description given hereinlater.

BRIEF DESCRIPTION OF THE DRAWINGS

FIG. 1-A is a fragmentary enlarged view of FIG. 1;

FIG. 2-A is a fragmentary enlarged view of FIG. 2;

FIG. 3-A, FIG. 3-B are fragmentary enlarged views of FIG. 3;

FIG. 4 is an exploded perspective view of a nonleak valve in the first embodiment;

FIG. 4-A is a perspective view of a cylindrical casing of a nonleak valve in the third embodiment.

DETAILED DESCRIPTION OF PREFERRED EMBODIMENTS

Figure 1:
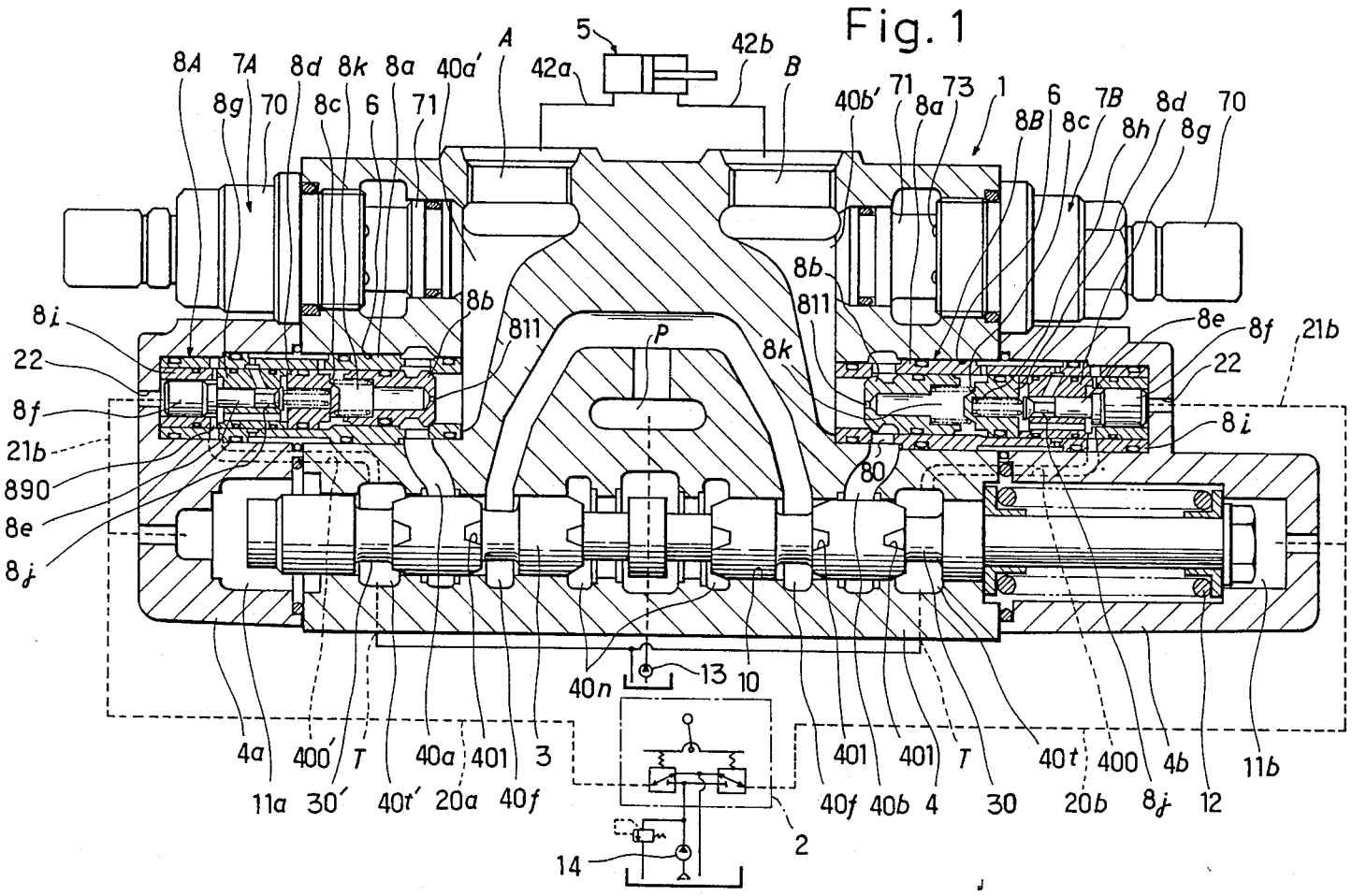
FIG. 1 is a longitudinal sectional side view representing a first embodiment of a hydraulic controller according to the invention.

FIG. 1 and FIG. 1-A represent a first embodiment of a hydraulic controller according to the invention. In FIG. 1, 1 denotes a main valve, 2 denotes an oil pressure pilot valve, and 5 denotes an actuator or, for example, cylinder. A finger-touch type remote control valve is employed for the oil pressure pilot valve 2 in the embodiment, which is ready for receiving oil from a pilot pump 14 separate from a main pump 13 for the main valve. A reference numeral 3 denotes a main spool, which is fitted slidably in a bore 10 provided on a valve body 4 of the main valve 1. Opposite ends of the main spool project to pilot pressure chambers 11*a*, 11*b* of cover plates 4*a*, 4*b* fixed on opposite sides of the valve body, and one end is energized by a return spring 12 in the pilot pressure chamber 11*b* and set at an indicated neutral position in the normal state.

A pump port P communicating with the main pump 13 is provided centrally of the valve body 4, low pressure passages 40*t*, 40*t'* communicating with tank ports T, T are formed on opposite ends, a neutral passage 40*n* is formed centrally thereof, and feeder passages 40*f*, and 40*f'* are formed on opposite sides. Further, two sets of cylinder passages 40*a*, 40*a'* and 40*b*, 40*b'* in separate structure to cylinder ports A, B are formed on the valve body 4. Cylinder passages 40*a'*, 40*b'* open to the cylinder ports A, B at the noses and stop halfway in the valve body at the terminals. Then, the cylinder passages 40*a*, 40*b* lead to the bore 10 at the terminals and stop at positions shifted in phase with terminals of the cylinder passages 40*a'*, 40*b'* at the noses. The cylinder ports A, B are connected to the actuator 5 such as oil hydraulic motor, hydraulic cylinder or the like.

A notch 401 is formed on the main spool 3 at a necessary port, and end portion stems 30, 30' are formed near opposite ends of the spool so as to position at the low pressure passages 40*t*, 40*t'* in a neutral state. A switching construction is such that when the main spool 3 shifts leftward in the drawing, the cylinder passage 40*a* on a left end side and the low pressure passage 40*t'* are kept as intercepted, and the end portion stem 30 keeps the low pressure passage 40*t* and the cylinder passage 40*b* communicating with each other on the right end side.

A horizontal tunnel 6 with the nose open to the other cylinder passage 40*a'*, 40*b'* across the one cylinder passage 40*a*, 40*b* is perforated in a portion covering the valve body 4 and the cover plates 4*a*, 4*b*. The horizontal tunnel 6 is parallel with the main spool 3, and two nonleak valves 8A, 8B are disposed symmetrically in the horizontal tunnel 6. In the embodiment, overload relief valves 7A, 7B with, for example, a relief valve and an anticavitation valve combined therefor are inserted in the valve body 4 on upper portion of the nonleak valves 8A, 8B. The overload relief valves 7A, 7B will be described in detail in the third embodiment.

FIG. 1-A and FIG. 4 represent the nonleak valves 8A, 8B in detail. In the embodiment, the nonleak valves 8A, 8B comprise each disposing, on the same axis, a cylindrical casing 8*a* fitted in the horizontal tunnel 6, a main passage switching poppet 8*b* inserted therein, a spring 8*c* for energizing it, a spring bearing 8*d* for the spring 8*c*, a pilot poppet 8*e* for controlling pressure of a spring chamber 8*k* of the poppet 8*b*, and a piston 8*f* for operating the pilot poppet 8*e*.

The cylindrical casing 8*a* is positioned from having the axial nose opened to the cylindrical passages 40*a'*, 40*b'* on a cylinder port side and the axial rear end kept in contact with an end wall 60 of the horizontal tunnel 6. A plurality of oil holes 80 are disposed through a wall of the cylindrical casing 8*a* at portions corresponding to the cylinder passages 40*a*, 40*b*. Then, a small diametral part 82 is formed intermediately of the cylindrical casing coming rearward of the oil holes 80, forming a ring passage 85 with the horizontal tunnel 6. An outlet hole 83 and an inlet hole 84 are provided on the small diametral part 82 through the cylinder wall. Further, a discharge hole 86 communicating with the low pressure passages 40*t*, 40*t*' through passages 400, 400' is perforated in the cylindrical casing 8*a* at a portion near the rear end. Then, the cylindrical casing 8*a* is mounted with a seal ring 15 in contact close with the horizontal tunnel 6 on both side portions of each hole.

The poppet 8*b* is caplike in shape, seated on a force of the spring 8*c* on a seat part 810 incorporated in the cylindrical casing 8*a* around the oil holes 80, and is provided with a throttle 811 centrally of a nose of the cap.

The spring bearing 8*d* is caplike in shape and forms the spring chamber 8*k* with the poppet 8*b*. Then, the spring bearing 8*d* bears the spring 8*c* on the nose side, and an annular part 830 for conducting the outlet hole 83 of the cylindrical casing 8*a* and the spring chamber 8*k* internally is formed on an outer diametral side of the bearing portion.

The pilot poppet 8*e* is provided with a main part with an oil groove formed axially on the outer periphery, a shaft part smaller in size than that, a head part larger in size than the main part, of which the main part is inserted slidably in a bore 860 of a valve body 8*g* fitted in the cylindrical casing 8*a*. Then, a spring 8*h* disposed in a recession of the spring bearing 8*d* comes in contact with the head part, thus coming to seat on the spring force at a nose of the valve body 8*g*. The valve body 8*g* is brought into contact with the spring bearing 8*d* on its one end face and also with a guide bush 8*i* of the piston 8*f* on the other end face, and the valve body 8*g* is positioned from the guide bush 8*i* coming in contact with the end wall 60 of the horizontal tunnel.

A guide hole 850 connecting the inlet hole 84 of the cylindrical casing 8*a* and a valve chest 8*j* on an outer periphery of the shaft part of the pilot poppet 8*e* is perforated in the valve body 8*g*. On the other hand, an axial passage hole 880 is perforated at a position displaced in a circumferential direction from the guide hole 850, and the axial passage hole 880 communicates with recessions 870, 871 on front and rear end surfaces of the valve body 8*g*. Then, the one recession 871 communicates with the discharge hole 86 of the cylindrical casing 8*a* by way of a notch hole 890 formed on an end surface of the guide bush 8*i*.

The piston 8*f* is inserted in the guide bush 8*i* so as to come in contact with a rear end surface of the pilot poppet 8*e*, and is ready for receiving a pilot pressure from a pilot port 22 open to the end wall 60 of the horizontal tunnel 6. The pilot port 22 is connected to branch passages 21*a*, 21*b* of pilot passages 20*a*, 20*b* leading from the oil pressure pilot valve 2 to the pilot pressure chambers 11*a*, 11*b* of the main valve 1. The branch passages 21*a*, 21*b* may be formed on the cover plates 4*a*, 4*b* as internal passages so as to communicate with the pilot pressure chambers 11*a*, 11*b*.

Figure 2:
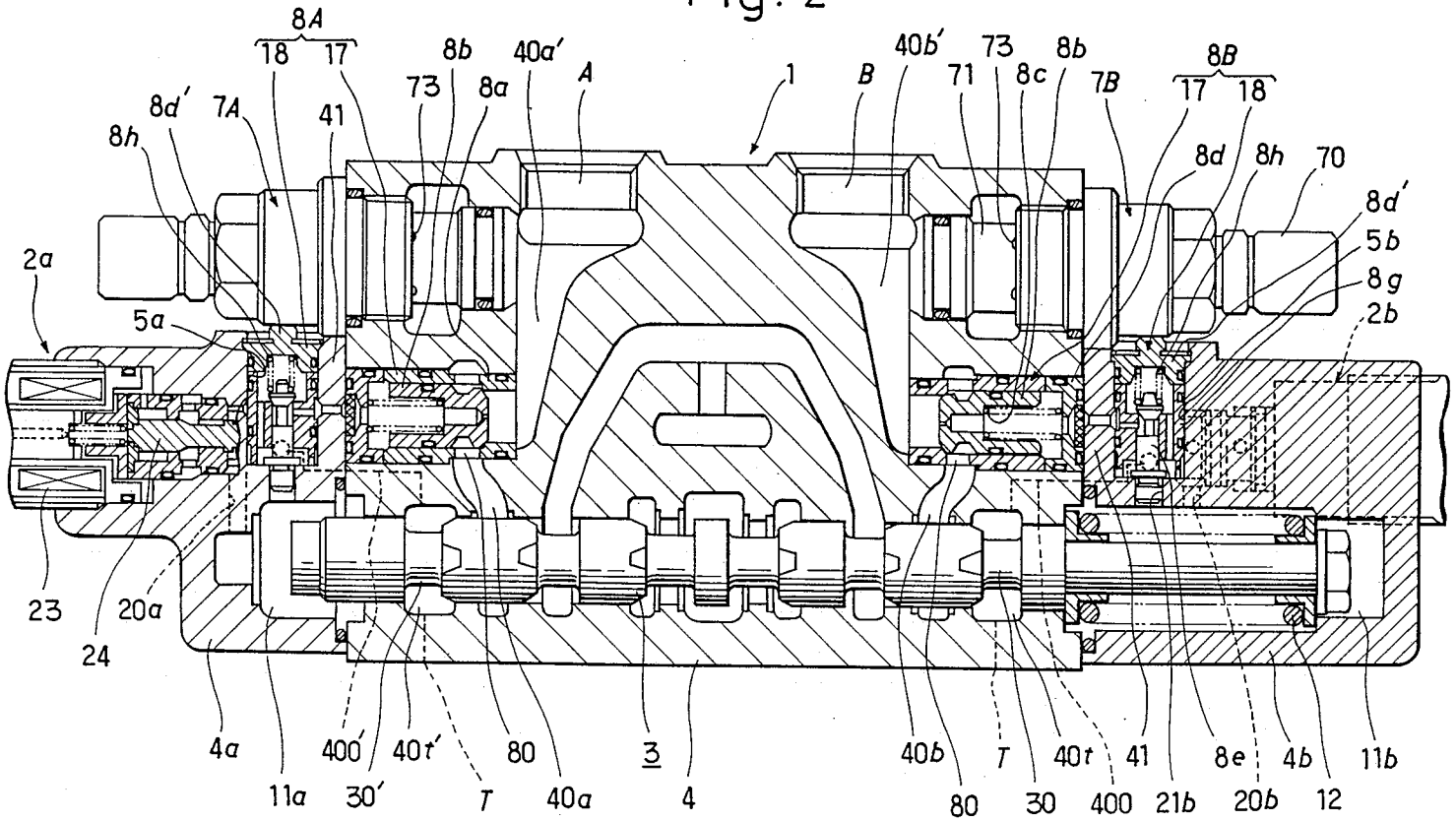
FIG. 2 is a longitudinal sectional side view representing a second embodiment of the invention.

FIG. 2 and FIG. 2-A represent a second embodiment of the invention. In the embodiment, a solenoid proportional pilot valve is employed for oil pressure pilot valves 2*a*, 2*b*, which are mounted on the cover plates 4*a*, 4*b* with the phase shifted from the nonleak valves 8A, 8B. The solenoid proportional pilot valves 2*a*, 2*b* are of normal closed type, and from exciting a solenoid 23, a pilot spool 24 shifts, and thus a pilot pressure oil is fed to the pilot pressure chambers 11*a*, 11*b* through the pilot passages 20*a*, 20*b* of the cover plates 4*a*, 4*b*.

Then, in the embodiment, the nonleak valves 8A, 8B are divided into a first assembly 17 and a second assembly 18. The first assembly 17 has the short cylindrical casing 8*a* and the cuplike spring bearing 8*d* on the same axis, and the main passage switching poppet 8*b* and the spring 8*c* for energizing it to a close side are enclosed therein. The first assembly 17 is enclosed in the horizontal tunnel 6 of the valve body 4.

On the other hand, longitudinal holes 5*a*, 5*b* are formed on the cover plates 4*a*, 4*b* through a partition part 41, and the second assembly 18 is enclosed in the longitudinal holes 5*a*, 5*b*. The second assembly 18 has a caplike spring bearing 8*d*' and the pilot poppet body 8*g* on the same axis, and the spring 8*h* and the pilot poppet 8*e* are disposed serially therein. The subpassages 21*a*, 21*b* for connecting the longitudinal holes 5*a*, 5*b* and the pilot pressure chambers 11*a*, 11*b* are provided under the pilot poppet 8*e*, and the collar piston 8*f* is disposed in the subpassages 21*a*, 21*b*.

In the embodiment, the outlet hole 83 is formed through the spring bearing 8*d*, the inlet hole 84 is perforated in the partition part 41, which communicates with the valve chest 8*j* of the pilot poppet 8*e* through the guide hole 850 of the valve body 8*g* of the pilot poppet, and a filter 19 is provided between the outlet hole 83 and the guide hole 850. Then, the axial passage hole 880 of the valve body 8*g* of the pilot poppet opens to the recession 871, and is conducted through to the low pressure passages 40*t*, 40*t*' by way of the discharge hole 86 perforated in the longitudinal holes 5*a*, 5*b* and the passages 400, 400'. Then, like parts are identified by the same reference characters in the case of first embodiment, for which a further description will be omitted.

The oil pressure pilot valve is not necessarily limited to that of the embodiment, and hence a solenoid proportional valve may be applied to the first embodiment, and an oil pressure pilot valve may be employed for the second embodiment.

Figure 3:
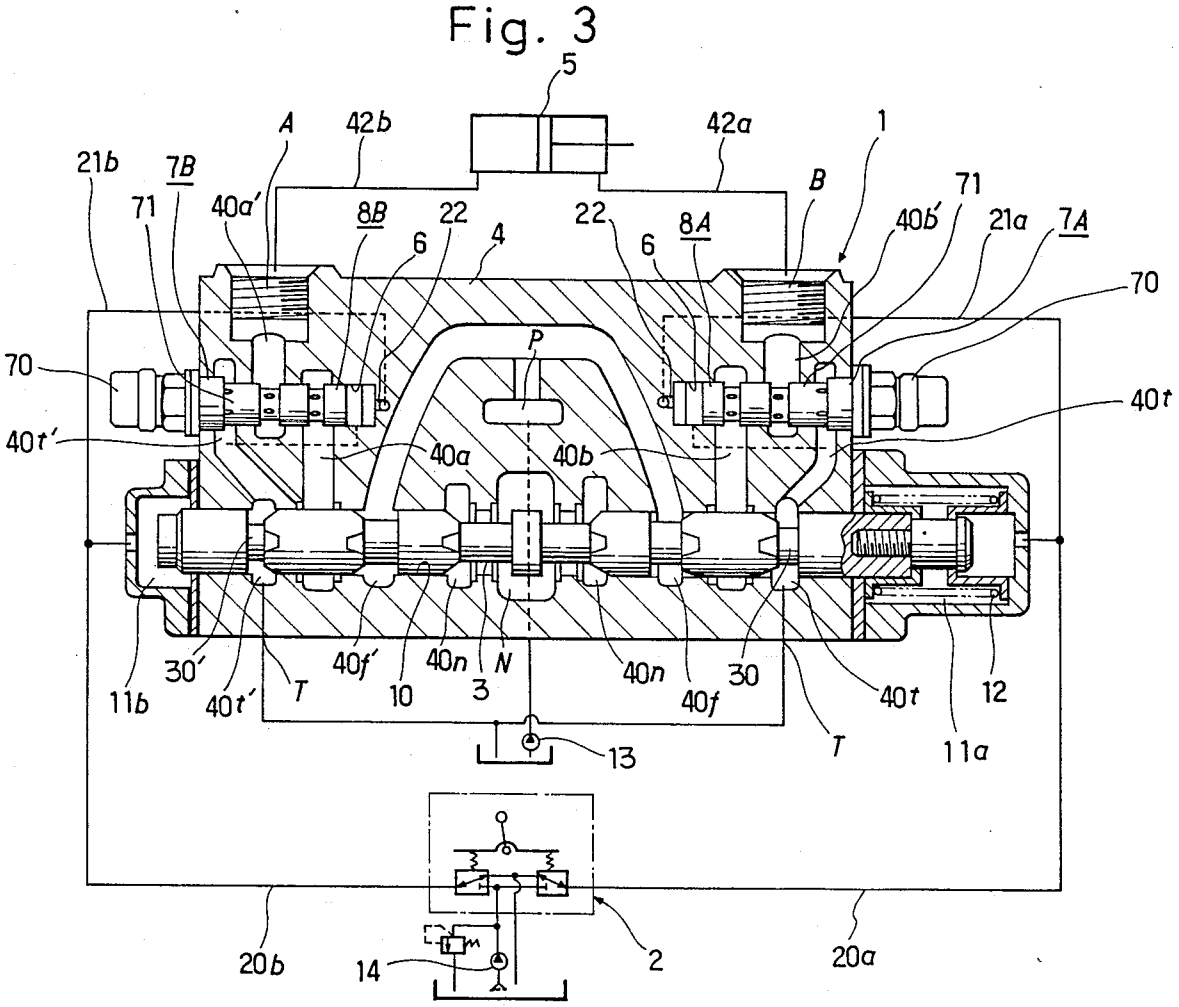
FIG. 3 is a longitudinal sectional side view representing a third embodiment of the invention.

FIG. 3, FIG. 3-A and FIG. 3-B represent a third embodiment of the invention. In the embodiment, the nonleak valves 8A, 8B and the overload relief valves 7A, 7B are disposed on the same axis in the horizontal tunnels 6, 6 intersecting the two sets of cylinder passages 40*a*, 40*a*', 40*b*, 40*b*' of separate structure. More specifically, the nonleak valves 8A, 8B are disposed on the inner side of the horizontal tunnels 6, 6, and the overload relief valves 7A, 7B are disposed on the inlet side of the horizontal tunnels 6, 6.

The overload relief valves 7A, 7B are constructed from having a relief valve and an anticavitation valve combined therefor.

That is, a cylindrical body 71 with the nose facing on the cylinder passages 40*a*', 40*b*' is inserted in a holder 70 thrust in the valve body 4 by an intermediate screw 72. The cylindrical body 71 has a plurality of through holes 73 communicating with the low pressure passages 40*t*, 40*t*' provided through the cylinder wall at portions near the intermediate screw 72.

An antivoid valve 74 and a relief valve 75 are disposed slidably on an inside of the cylindrical body 71. The antivoid valve 74 is cylindrical, the relief valve 75 incorporates a filter 741 therein at a position near the nose, and a throttle 742 is perforated therein centrally of the portion on downstream side therefrom.

The two valves 74, 75 have outer collars 740, 750 corresponding to inner collars 710, 711 of the cylindrical body 71 on an outer periphery of the rear portion respectively, and the antivoid valve 74 is pushed so as to have the outer collar 740 brought into contact with the inner collar 710 by a spring 760 disposed in a space against a ring spring bearing 76 on a nose inside of the cylindrical body 71.

The relief valve 75 is pushed so as to have the outer collar 750 brought into contact with the inner collar 711 by a spring 770 disposed in a space against a spring bearing 77 fitted in the cylindrical body 71 on a rear end inside. Accordingly, both valves 74, 75 have the end portions seated mutually at an inside portion of the through hole 73, thus intercepting the cylinder passage **40*b*' or 40*b* and the low pressure passage 40*t* or 40*t*'** at ordinary times.

Then, a passage 78 communicating with the low pressure passage **40*t* or 40*t*' through a notch groove crossing with the intermediate screw 72 is formed between outer periphery of the cylindrical body 71 and the horizontal tunnel 6, and a through hole 771 communicating with the spring chamber is perforated in the spring bearing 77. The spring bearing 77 is ready for adjusting a relief pressure by a push of an adjusting bolt 79**.

The nonleak valves 8A, 8B are almost same in structure as the first embodiment shown in FIG. 1. That is, each of the nonleak valves 8A, 8B has the cylindrical casing **8*a* fitted in the horizontal tunnel 6, the main passage switching poppet 8*b* inserted therein, the spring 8*c* for energizing it, the spring bearing 8*d* of the spring 8*c*, the pilot poppet 8*e* for controlling a pressure of the spring chamber 8*k* of the poppet 8*b*, and the piston 8*f* for operating the pilot poppet 8*e*** disposed on the same axis.

In the third embodiment, however, the cylindrical casing **8*a* is positioned from the rear end coming in contact with the end wall 60 of the horizontal tunnel 6 and the nose coming in contact with the cylindrical body 71 of the overload relief valve 7. That is, the cylindrical casing 8*a* has a portion extending into the cylinder passages 40*a*', 40*b*', and a plurality of oil holes 81, 81 are formed on the portion. An oil coming into the cylinder passages 40*a*', 40*b*' from the cylinder ports A, B flows toward the nonleak valves 8A, 8B and the overload relief valves 7A, 7B through the oil holes 81, 81**.

Then, in the third embodiment, the piston **8*f* faces on the end wall 60 of the horizontal tunnel 6, the pilot port 22 opens on this portion, and the branch passages 21*a*, 21*b* of the pilot passages 20*a*, 20*b* are connected thereto as shown in FIG. 3**.

Like parts are identified by the same reference characters in the case of first embodiment, and hence a further description will be omitted here.

In the first embodiment, when the main spool 3 is neutral, the end portion stems 30, 30' of the main spool 3 communicate with the low pressure passages **40*t*, 40*t*'. In this case, each main passage switching poppet 8*b* of the nonleak valves 8A, 8B opens on the cylindrical casing 8*a*. Thus, the two-divided cylinder passages 40*a*, 40*a*', and 40*b*, 40*b* ' are intercepted. A pilot pressure will not work on the left and right pilot ports 22, 22 unless the oil pressure pilot valve is operated, the pistons 8*f*, 8*f* do not move accordingly, and the pilot poppets 8*e*, 8*e*** are kept close.

A load pressure from the actuator 5 such as oil hydraulic motor or the like works on the cylinder ports A, B, and an oil of the cylinder ports A, B flows into the cylindrical casings **8*a*, 8*a* from the cylinder passages 40*a*', 40*b* ' by way of the oil holes 80, 80. Then, it is stored in a passage chamber in the flow indicated by an arrow of FIG. 1-A. That is, it passes the throttle 811 of the main passage switching poppet 8*b* and flows into spring chamber 8*k* → outlet hole 83→ring passage 85→inlet hole 84→guide hole 850→pilot poppet chest 8*j*. Thus, the load pressure of the cylinder ports A, B is retained securely, and if the oil in the passage chamber leaks from outer periphery of the pilot poppet 8*e* and the sliding hole 860, then it is very little, and a pressure of the actuator 5** will scarcely drop.

Now, if the oil pressure pilot valve 2 is operated so as to move the main spool 3, a pilot pressure comes into the pilot pressure chamber **11*b* from the pilot passage 20*b* on the right side, and pushes the main spool 3 horizontally. Concurrently, the pilot pressure is fed to the pilot port 22 on the right side through the subpassage 21*b***.

The piston **8*f* of the nonleak valve 8B on the right side travels in the guide bush 8*i* on the pilot pressure, and the pilot poppet 8*e* is moved to open leftward against the spring 8*h*, or in the direction counter to that in which an oil from the cylinder passage 40*b* ' flows. Thus, the oil shut up in a route from the spring chamber 8*k* to the valve chest 8 flows from the low pressure passage 40*t* to the tank port T by way of recession 870→axial passage hole 880→recession 871→notch hole 890→discharge hole 86→passage 400 as indicated by a dotted line arrow of FIG. 1-A. As a result, a pressure of the spring chamber 8*k* of the main passage switching poppet 8*b* drops, and a pressure difference arises longitudinally of the throttle 811, therefore the poppet 8*b* of the nonleak valve 8B on the right side parts from the seat part 810 of the cylindrical casing 8*a*, and shifts (open) rightward. Thus, the cylinder passages 40*b* and 40*b*** ' communicate with each other.

Generally in the hydraulic pilot type control valve, the main spool 3 does not move before a pilot pressure reaches about 3 kg/cm$^2$, but if the pressure comes up to exceed, and the main spool 3 commences a stroke, an overlap domain is set such that a change does not arise on the oil passage for a predetermined stroke. On the other hand, an opening pressure of the main passage switching poppet **8*b* can be set arbitrarily regardless of a magnitude of the load pressure. Accordingly, if the pilot pressure to the main spool 3 is led concurrently to the piston 8*f*, then before the notch 401 of the main spool 3 opens according to the overlap domain, the return side cylinder passages 40*b*, 40*b* ' communicate with each other, as mentioned hereinbefore, by the main passage switching poppet 8*b*. Next the end portion stem 30 rightward of the main spool 3 has the cylinder passage 40*b* communicate with the low pressure passage 40*t*. Thus, a return oil from the oil hydraulic motor passes a nose of the main passage switching poppet 8*b*, and is returned smoothly to the tank by way of cylinder passage 40*b*→low pressure passage 40*t***→tank port T.

On the other hand, the main passage switching poppet **8*b* of the left nonleak valve 8A functions as a check valve, and when the pump port P and the cylinder passage 40*b* communicate with each other on a leftward move of the main spool 3, the poppet 8*b* opens on a pressure of the cylinder passage 40*a*, a main flow moves from the cylinder passage 40*a*' to the cylinder port A, and a pressure oil is fed from a passage 42*a* to the actuator 5**.

In case the oil pressure pilot valve 2 is actuated so as to move the main spool 3 rightward, the left nonleak valve 8A opens on a successive operation to make the return cylinder passages **40*a*, 40*a*'** communicate with each other, and a flow of the hydraulic fluid is reversed.

Otherwise the construction remains same as mentioned hereinabove.

In the second embodiment, from exciting a solenoid of the solenoid proportional oil pressure pilot valve 2b on the right side, a pilot spool 24 shifts to allow a pilot oil pressure into the pilot pressure chamber 11b from the pilot passage 20b, and the pilot pressure works on the piston 8f of the right side nonleak valve 8B by way of the subpassage 21b communicating with the pilot pressure chamber 11b. Thus, the pilot poppet 8e is pushed, ascends in the valve body 8g to open. The oil stored in the spring chamber 8k enters the longitudinal hole 5b by way of spring chamber 8k→outlet hole 83→filter 19→inlet hole 84, and flows out to the low pressure passage 40t by way of outlet hole 850→valve chest 8j →axial passage hole 880→recession 871→discharge hole 86→passage 400. Other operation and function are same as in the case of the first embodiment.

Referring next to operation and function of the third embodiment, in a neutral state of the main spool 3 shown in FIG. 3, a load pressure from the actuator 5 works on the cylinder ports A, B, and an oil from the cylinder ports A, B flows into the cylindrical casing 8a from the cylinder passages 40a', 40b' by way of the oil hole 81. Then the oil branches away horizontally. The one passes the throttle 811 of the main passage switching poppet 8b and is stored in a passage chamber comprising spring chamber 8k→outlet hole 83→ring passage 85→inlet hole 84→guide hole 850→pilot poppet chest 8j. Then, the other passes in the antivoid valve 74 and arrives at the spring chamber by way of the filter 741 and the throttle 742 of the relief valve 75. The load pressure of the cylinder ports A, B is retained securely, consequently.

Now, from operating the oil pressure pilot valve 2 so as to actuate the main spool 3 leftward, a pilot pressure enters the pilot pressure introducing part 11afrom the pilot passage 20a and is fed to the pilot port 22 through the branch passage 21a. The piston 8f is moved by the pilot pressure, the pilot poppet 8e opens, and the oil shut up in the route as far as the valve chest 8j flows into the tank port T from the low pressure passage 40t by way of recession 870 axial passage hole 880→recession 871 notch hole 890→discharge hole 86→communicating passage 400. Thus a spring chamber pressure of the main passage switching poppet 8b drops, and the poppet 8b opens according to a pressure difference longitudinal of the throttle 811. Other operation and function are same as in the case of the first embodiment.

Then, in any embodiments, an external force works on the actuator 5 in a neutral state of the main spool 3, and when it exceeds a set pressure, the relief valve 75 moves rightward in FIG. 3-A (left side in FIG. 3-B) against the spring 770 according to a pressure difference longitudinal of the throttle 742. Thus the cylinder passage 40a' or 40b' communicates with the low pressure passage 40t or 40t' by way of the through hole 73, and a hydraulic fluid is returned to the tank. Then, when the actuator 5 is moved on an external force and a negative pressure works on the cylinder port A or B, the antivoid valve 74 moves leftward in FIG. 3-A (right side in FIG. 3-B) against the spring 760, thus the hydraulic fluid is sucked up thereby from the low pressure passage 40t or 40t', and is fed to the cylinder passage 40a' or 40b'.

What is claimed is:

1. In a hydraulic controller equipped with a directional control valve disposed on a system connecting an actuator from an oil hydraulic pump, the directional control valve having a main spool running through a valve body, the main spool being operated on an external pilot oil pressure, the improvement characterized in that:

two sets of cylinder passages 40a, 40a' and 40b, 40b' of a separate structure are formed on the valve body 4, horizontal tunnels 6, 6 are formed so as to intersect each set of the cylinder passages 40a, 40a' and 40b, 40b', nonleak valves 8A, 8B are mounted on the horizontal tunnels 6, 6 each;

said nonleak valves 8A, 8B are equipped each with a main passage poppet 8b having a switching nose and a throttle 811 on the nose, a spring 8c for energizing it normally to a close side, a pilot poppet 8e for controlling pressure of a spring chamber 8k with the spring disposed therein, a piston 8f for operating the pilot poppet 8e;

the nonleak valves 8A, 8B have a passage structure whereby a load pressure oil from a cylinder port is shut up around the pilot poppet 8e by way of the throttle 811, the spring chamber 8k and the horizontal tunnel 6, when a main spool 3 is neutral;

pilot passages 20a, 20b leading to an end portion of a main spool 1 from an oil pressure pilot valve communicate partly with the piston 8f of the nonleak valves 8A, 8B, and when a pilot oil pressure is applied to the main spool 1, the pilot oil pressure works on the piston 8f concurrently.

2. The hydraulic controller as defined in claim 1, wherein the two nonleak valves 8A, 8B are incorporated in cylindrical casings 8a, 8a each, the cylindrical casings 8a, 8a are mounted symmetrically each toward the valve body 4 and cover plates 4a, 4b fixed on opposite sides thereof, further each cylindrical casing 8a is kept parallel with the main spool 3.

3. The hydraulic controller as defined in claim 1, wherein said valve body 4 has cover plates 4a, 4b, and wherein each of the two nonleak valves 8A, 8B is divided into a first assembly incorporating a cylindrical casing 8a, the main passage switching poppet 8b and the spring 8c for energizing it to a close side at ordinary times in the cylindrical casing 8a, and a second assembly including the pilot poppet 8e and the piston 8f for operating the pilot poppet 8e, the first assembly is disposed on the valve body 4, the second assembly is disposed on the cover plates 4a, 4b, a back of the piston 8f communicates with pilot pressure chambers 11a, 11b of the main spool 3.

4. The hydraulic controller as defined in claim 1, wherein the two nonleak values 8A, 8B are incorporated in cylindrical casings 8a, 8a each, the cylindrical casings 8a, and 8a are mounted symmetrically each toward the valve body 4 and cover plates 4a, 4b fixed on opposite sides thereof, further each cylindrical casing 8a is kept parallel with the main spool 3, and overload relief valves 7A, 7B are mounted in parallel with the cylindrical casings 8a, 8a on the valve body 4 at portions coming near to the cylinder port rather than the nonleak valves 8A, 8B.

5. The hydraulic controller as defined in claim 1, wherein said valve body 4 has cover plates 4a, 4b, and wherein each of the two nonleak valves 8A, 8B is divided into a first assembly incorporating a cylindrical casing 8a, the main passage switching poppet 8b and the spring 8c for energizing it to a close side at ordinary times in the cylindrical casing 8a, and a second assembly including the pilot poppet 8e and the piston 8f for operating the pilot poppet 8e, the first assembly is disposed on the valve body 4, the second assembly is disposed on the cover plates 4a, 4b, a back of the piston 8f communicates with pilot pressure chambers 11a, 11b of the main spool 3, and overload relief valves 7A, 7B are mounted in parallel with the cylindrical casings 8a, 8a on the valve body 4 at portions coming near to the cylinder port rather than the nonleak valves 8A, 8B.

6. The hydraulic controller as defined in claim 1, wherein the two nonleak valves 8A, 8B are incorporated in cylindrical casings 8a, 8a and are disposed in the horizontal tunnels 6, 6, further overload relief valves 7A, 7B are mounted in the horizontal tunnels 6, 6 on the same axis as the nonleak valves 8A, 8B respectively.

7. The hydraulic controller as defined in any of claim 1 or claim 2 or claim 4, wherein:

said valve body 4 includes tank port;

the nonleak valves 8A, 8B are incorporated in cylindrical casings 8a, 8a, and the main passage switching poppet 8b, the spring 8c for energizing it, a caplike spring bearing 8d for bearing the spring 8c, a pilot poppet body 8g for supporting the spring bearing 8d, and a guide bush 8i for supporting it are disposed in series within the cylindrical casing 8a; and main passage switching poppet 8b being caplike;

the pilot poppet 8e is disposed slidably at the center of the pilot poppet body 8g, the piston 8f is disposed also slidably within the guide bush 8i, and the pilot poppet 8e is energized to a close side by a spring 8h disposed within the spring bearing 8d;

the cylindrical casing 8a opens to the cylinder passages 40a', 40b' at the axial nose, has a plurality of oil holes 80 communicating with the cylinder passages 40a, 40b at portions corresponding to the cylinder passages 40a, 40b, and the main passage switching poppet 8b is seated between the oil holes 80 and an opening of the axial nose;

a ring passage 85 is formed between the outer periphery of an intermediate portion of the cylindrical casing 8a and the horizontal tunnel 6, the ring passage 85 communicates with the spring chamber 8k through an outlet hole 83 passing through a wall of the cylindrical casing 8a, the ring passage 85 also communicates with a valve chest 8j formed on the outer periphery of a fine shaft portion of the pilot poppet 8e through an inlet hole 84 passing through a wall at a position displaced from the outlet hole 83 and a guide hole 850 intersecting with an axis of the pilot poppet body 8g, the valve chest 8j is then closed according as the pilot poppet 8e is closed, and when the pilot poppet 8e opens, it comes to communicate with the tank port from a passage hole 880 formed axially of the pilot poppet body 8g through a back of the pilot poppet 8e and further a discharge hole 86 passing through the wall of the cylindrical casing 8a.

8. The hydraulic controller as defined in claim 1 or 5, wherein: said valve body 4 has cover plate 4a, 4b;

the first assembly of each of the nonleak valves 8A, 8B has a short cylindrical casing 8a and a cuplike spring bearing 8d on the same axis, said cuplike spring bearing 8d having an outlet hole 83, the cuplike spring bearing 8d is disposed in the horizontal tunnel 6 so as to come in contact close with the cover plates 4a, 4b, the main passage switching poppet 8b and the spring 8c are contained within the first assembly; said cover plates 4a, 4b having an inlet hole 84;

the second assembly has a caplike spring bearing 8d' and the pilot poppet body 8g combined on the same axis therefor, said pilot poppet body 8g having a guide hole 850, the second assembly is fitted in longitudinal holes 5a, 5b formed on the subplates 4a, 4b, the spring 8h and the pilot poppet 8e are disposed within the second assembly, the piston 8f faces on subpassages 21a, 21b connecting the longitudinal holes 5a, 5b and the pilot pressure chambers 11a, 11b of the main spool 3; said pilot poppet 8e having a valve chest 8j;

the spring chamber 8k of the first assembly communicates with the longitudinal holes 5a, 5b through the outlet hole 83 passing through the spring bearing 8d and the inlet hole 84 passing through a wall of the subplate, the longitudinal holes 5a, 5b communicate with the valve chest 8j of the pilot poppet 8e through the guide hole 850 intersecting an axis of the pilot poppet body 8g.

9. The hydraulic controller as defined in claim 6, wherein:

said valve body 4 includes tank port;

the nonleak valves 8A, 8B have the cylindrical casing 8a each, the main passage switching poppet 8b, the spring 8c for energizing it, a spring bearing 8d for bearing the spring 8c, a pilot poppet body 8g for supporting the spring bearing 8d, and a guide bush 8i for supporting it are disposed in series within the cylindrical casing 8a; said main passage switching poppet 8b being caplike;

the pilot poppet 8e is disposed slidably at the center of the pilot poppet body 8g, the piston 8f is disposed also slidably within the guide bush 8a, and the pilot poppet 8e is energized to a close side by a spring 8h disposed within the spring baring 8d;

the cylindrical casing 8a has a plurality of oil holes 80 communicating with the cylinder passages 40a, 40b at portions corresponding to the cylinder passages 40a, 40b, and the main passage switching poppet 8b is seated between the oil holes 80 and an opening of the axial nose;

the cylindrical casing 8a has the nose portion extended into the cylinder passages 40a', 40b', the nose surface brought into contact with a cylindrical body 71 of the overload relief valves 7A, 7B, a plurality of oil holes 81 formed on the portion facing on the cylinder passages 40a', 40b' through the wall, and an oil from the cylinder passages 40a', 40b' is distributed to the nonleak valves and the overload relief valves by the oil holes 81;

a ring passage 85 is formed between the outer periphery of an intermediate portion of the cylindrical casing 8a and the horizontal tunnel 6, the ring passage 85 communicates with the spring chamber 8k through an outlet hole 83 passing through a wall of the cylindrical casing 8a, the ring passage 85 also communicates with a valve chest 8j of the pilot poppet 8e through an inlet hole 84 passing through a wall at a position displaced from the outlet hole 83 and a guide hole 850 intersecting with an axis of the pilot poppet body 8g, the valve chest 8j is then closed according as the pilot poppet 8e is closed, and when the pilot poppet 8e opens, it comes to communicate with the tank port from a passage hole 880 formed axially of the pilot poppet body 8g through a back of the pilot poppet 8e and further a discharge hole 86 passing through the wall of the cylindrical casing 8*a*.

10. The hydraulic controller as defined in any of claims 5, 6, wherein the overload relief valves 7A, 7B are provided with a cylindrical body 71, the cylindrical body 71 has a passage hole 73 communicating the low pressure passages 40*t*, 40*t'* at ordinary times at the intermediate portion, an antivoid valve 74 and a relief valve 75 are disposed within the cylindrical body 71 on the same axis, and butted by springs 76, 770, the relief valve 75 has a throttle 742 axially.

11. The hydraulic controller as defined in any one of claims 1 to 6, comprising a switching construction wherein end portion stems 30, 30' of the main spool 3 are positioned in low pressure passages 40*t*, 40*t'* at a neutral state, and when the main spool 3 shifts on a pilot pressure, the low pressure passage 40*t* and the cylinder passage 40*b* communicate with each other by the end portion stem 30 on a side where the pilot pressure is applied, but the lower pressure passage 40*t'* and the cylinder passage 40*b'* on a counter side are kept intercepted.

* * * * *